US008672159B2

(12) United States Patent
Moreira

(10) Patent No.: US 8,672,159 B2
(45) Date of Patent: Mar. 18, 2014

(54) HOLLOW PRODUCT WITH LOCALIZED RELIEF FOR VACUUM SEALING

(75) Inventor: Philippe Moreira, Sucy en Brie (FR)

(73) Assignee: Saint-Gobain Emballage, Courbevoie (FR)

( * ) Notice: Subject to any disclaimer, the term of this patent is extended or adjusted under 35 U.S.C. 154(b) by 293 days.

(21) Appl. No.: 12/681,729

(22) PCT Filed: Oct. 1, 2008

(86) PCT No.: PCT/FR2008/051771

§ 371 (c)(1), (2), (4) Date: Aug. 25, 2010

(87) PCT Pub. No.: WO2009/053574

PCT Pub. Date: Apr. 30, 2009

(65) Prior Publication Data

US 2011/0024382 A1 Feb. 3, 2011

(30) Foreign Application Priority Data

Oct. 5, 2007 (FR) ..... 07 58085

(51) Int. Cl.
*B65D 41/06* (2006.01)

(52) U.S. Cl.
USPC ..... 215/332; 215/329; 215/262

(58) Field of Classification Search
USPC ..... 215/329, 332, 335, 337, 262, 339, 281; 220/296
See application file for complete search history.

(56) References Cited

U.S. PATENT DOCUMENTS

| | | | | | |
|---|---|---|---|---|---|
| 807,168 | A | * | 12/1905 | Hicks | 215/277 |
| 980,544 | A | * | 1/1911 | Lyon | 215/337 |
| 1,492,978 | A | * | 5/1924 | Hammer | 215/337 |
| 1,618,657 | A | * | 2/1927 | Hammer | 215/336 |
| 1,849,522 | A | * | 3/1932 | Hammer | 215/262 |
| 2,776,066 | A | * | 1/1957 | Thornton | 215/217 |
| 3,006,493 | A | * | 10/1961 | Acton | 215/337 |
| 3,061,132 | A | * | 10/1962 | Geddes | 215/262 |
| 3,519,159 | A | * | 7/1970 | Foss et al. | 215/256 |
| 3,656,647 | A | * | 4/1972 | Swinn | 215/208 |
| 3,692,200 | A | * | 9/1972 | Ritzenhoff | 215/256 |
| 3,844,443 | A | * | 10/1974 | Cudzik | 220/296 |
| 3,888,383 | A | * | 6/1975 | Rowlands | 220/265 |
| 4,032,028 | A | * | 6/1977 | Reiss et al. | 215/217 |
| 4,275,817 | A | * | 6/1981 | Patton | 215/217 |
| 4,473,163 | A | * | 9/1984 | Geiger | 215/250 |
| 4,552,279 | A | * | 11/1985 | Mueller et al. | 215/318 |
| 4,643,330 | A | * | 2/1987 | Kennedy | 220/288 |
| 4,721,220 | A | * | 1/1988 | Northup | 215/307 |

(Continued)

FOREIGN PATENT DOCUMENTS

| | | |
|---|---|---|
| AU | 538 613 | 8/1984 |
| EP | 0 080 142 | 6/1983 |

*Primary Examiner* — Anthony Stashick
*Assistant Examiner* — Christopher McKinley
(74) *Attorney, Agent, or Firm* — Oblon, Spivak, McClelland, Maier & Neustadt, L.L.P.

(57) ABSTRACT

A hollow vacuum packaging product in which a ring includes threads distributed around its periphery, and between which a sealing cap enters into engagement when the hollow product is opened/closed. In an evacuated closed condition of the hollow product, the sealing cap is configured to enter into engagement only in an interval between two consecutive threads, or in plural such consecutive intervals, but not in all of the intervals. Such a hollow product may be, as an example, a thermoplastic bottle or jar.

9 Claims, 2 Drawing Sheets

(56) References Cited

U.S. PATENT DOCUMENTS

Figure 1:
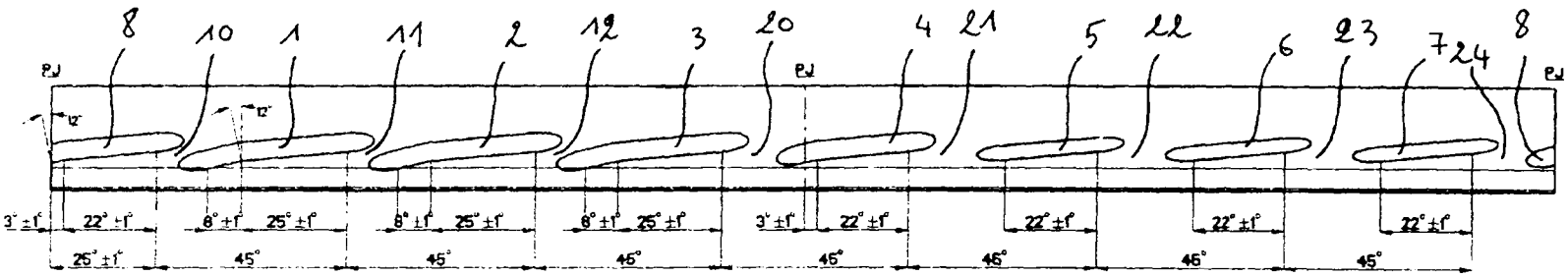

| | | | | | |
|---|---|---|---|---|---|
| 4,738,370 | A * | 4/1988 | Urmston et al. | 215/307 |
| 4,948,001 | A * | 8/1990 | Magly | 215/42 |
| 5,103,991 | A * | 4/1992 | Collins | 215/329 |
| 5,135,124 | A * | 8/1992 | Wobser | 215/222 |
| 5,197,617 | A * | 3/1993 | Edwards | 215/221 |
| 5,462,186 | A * | 10/1995 | Ladina et al. | 215/330 |
| 5,533,633 | A * | 7/1996 | King | 215/252 |
| 5,845,798 | A * | 12/1998 | Carrier | 215/330 |
| 5,984,124 | A * | 11/1999 | Takano | 215/252 |
| 6,006,930 | A * | 12/1999 | Dreyer et al. | 215/44 |
| 6,056,136 | A * | 5/2000 | Taber et al. | 215/252 |
| 6,220,466 | B1 * | 4/2001 | Hayes et al. | 215/276 |
| 6,913,157 | B2 * | 7/2005 | Oh | 215/330 |
| 7,182,213 | B2 * | 2/2007 | King | 215/330 |
| 7,246,713 | B2 * | 7/2007 | King | 215/330 |
| 7,331,479 | B2 * | 2/2008 | Oh | 215/332 |
| 7,527,159 | B2 * | 5/2009 | Brozell | 215/222 |
| 7,802,692 | B2 * | 9/2010 | Maejima et al. | 220/293 |
| 7,861,874 | B2 * | 1/2011 | Cook et al. | 215/331 |
| 8,091,724 | B2 * | 1/2012 | King | 220/296 |
| 2005/0029219 | A1 * | 2/2005 | Taber et al. | 215/349 |
| 2005/0242055 | A1 * | 11/2005 | Oh | 215/332 |

* cited by examiner

HOLLOW PRODUCT WITH LOCALIZED RELIEF FOR VACUUM SEALING

The present invention relates to a hollow product with localized relief or threads for vacuum packaging, in particular made of glass or other thermoplastic material.

The ring of this product comprises localized relief or threads consisting of elongated protuberances which are slightly inclined relative to the horizontal and distributed at regular intervals over the entire periphery.

The vacuum sealing cap cooperates with said threads for the opening/closing thereof. It comprises at least one seal which, upon contact with the hollow product, ensures a sealed closure. The seal is, therefore, compressed to a greater or lesser extent, preferably in a reversible manner, and in particular in the case of vacuum packaging.

In this case, the cap is thus compressed onto the ring. It is appropriate to position the threads sufficiently far down and at a certain incline relative to the horizontal to allow the opening of the cap. This measure aims to avoid the situation where the cap, which is flattened to a greater or lesser degree onto the ring due to the vacuum, passes below the threads and the opening of said cap is no longer possible.

The object of the invention is to perfect a thread configuration which is particularly suitable for vacuum packaging, reliably eliminating the case where the opening disclosed above is impossible, by breaking the vacuum rapidly.

To this end, the subject of the invention is a hollow vacuum packaging product in which the ring comprises threads distributed around its periphery, and between which the sealing cap enters into engagement when the hollow product is opened/closed, characterized in that in the evacuated closed condition of the hollow product, the sealing cap is able to enter into engagement only in an interval between two consecutive threads or in several such consecutive intervals, but not in all of said intervals.

The opening of the cap thus takes place in the following particular manner. In a first step, said cap is subjected to a rotation along the axis of the ring, lifting up said cap on one side, in an asymmetrical manner, such that the vacuum inside the hollow product is broken. Due to this breaking of the vacuum, therefore, the cap also has the tendency, in a second stage, to lift up—being slightly separated from the ring—on the side which has not already been lifted up.

By continuing to subject the cap to the aforementioned rotation, in a third stage it also enters into engagement between the threads which until now have been inoperative, completing the opening.

Thus, any possibility of the cap passing below the threads is avoided, the opening thereof being nevertheless guaranteed in the best possible manner due to the hollow product of the invention.

According to preferred features of the invention, said interval(s) in which the sealing cap is capable of entering into engagement in the closed evacuated condition of the hollow product are

- defined in their lower part by a thread with a double pitch and/or maximum evolute, and/or
- located in one half of the periphery of the ring, on a first side of the joint plane of the mold.

More specifically, the double pitch of the threads as their maximum evolute feature—in other words the length—make it possible to lower the thread and thus the area of engagement of the cap, which is desired in the present case of vacuum packaging. The evolute is defined as the angle of the ring corresponding to a thread, with the exception of the ends thereof, known as the lead-in and lead-out cutting values.

The feature of positioning intervals for the engagement of the cap on a first—single—side of the joint plane of the mold, is advantageous in that it makes it possible to avoid the situation where the threads with a maximum evolute cover one or two lines of the joint plane of the mold on the ring. More specifically, it is known that long threads covering the joint plane of the mold interfere to a greater or lesser degree with the releasing of the hollow product from the mold.

According to further preferred features of the hollow product of the invention, two threads covering the joint plane of the mold—i.e. diametrically opposing—have a non-maximum evolute—to facilitate the releasing of the hollow product from the mold as seen above—and/or double pitch.

This last feature aims to lower the lower part (of engagement of the cap) of the threads of the joint plane, at an intermediate level, which is higher than that of the threads located on said first side of the joint plane of the mold but lower than that of the threads located on the other (second) side of the joint plane. This measure is advantageous when the cap progressively enters into engagement with the threads of the joint plane, and then with the threads of the second side thereof, once the vacuum has been broken as explained above.

It may be easily seen that during these operations the cap is subjected to a maximum deformation at the start of its rotation, then progressively adopts its initial shape again, from the moment when the vacuum is broken. This progressive return to the initial shape thus passes through the successive steps of engagement with the rising low-level threads.

According to further advantageous features, the threads located in their entirety on a second side of the joint plane of the mold

- have a non-maximum evolute and/or
- a single pitch and/or
- non-maximum width, all these measures being liable to raise the low level thereof, of which the importance has already been explained (progressive engagement of the cap with the rising low-level threads).

The subject of the invention is also a thermoplastic jar, vial or bottle, in accordance with the hollow product disclosed above. In a particularly preferred manner, the invention relates to a product made of glass, however it may also be made of plastics material.

The invention is illustrated below with reference to the accompanying figures.

In FIG. 1 the evolute of a ring of a glass jar according to the invention is shown.

This ring conforms to the GME 20-12 standard of the International Technical Centre for Bottling and Packaging (CETIE) relative to a "stop ring for vacuum sealing".

The upper ends of two consecutive threads—excluding the end thereof—are in each case separated by an angular fraction of 45°.

The threads 1, 2 and 3 are located on a first side of the joint plane of the mold PJ

- having a double pitch (angle of 12° between the two different parts),
- maximum evolute: 25°+8°,
- and maximum thickness.

The lower part thereof is the lowest of all the threads.

Two threads 4 and 8 covering the joint plane PJ are consecutive thereto

- also having a double pitch (same angle of 12° as before) and
- maximum thickness, but
- non-maximum evolute: 22°+3 °.

The lower part thereof is higher than that of the threads 1, 2 and 3.

The threads 4, 8 are able to be released from the mold.

The three threads 5, 6 and 7 positioned on a second side of the joint plane PJ are consecutive thereto.

The threads 5, 6 and 7 have a single pitch, a non-maximum evolute (22°) and non-maximum thickness.

The lower part thereof is higher than that of the threads 4 and 8.

Figure 2:
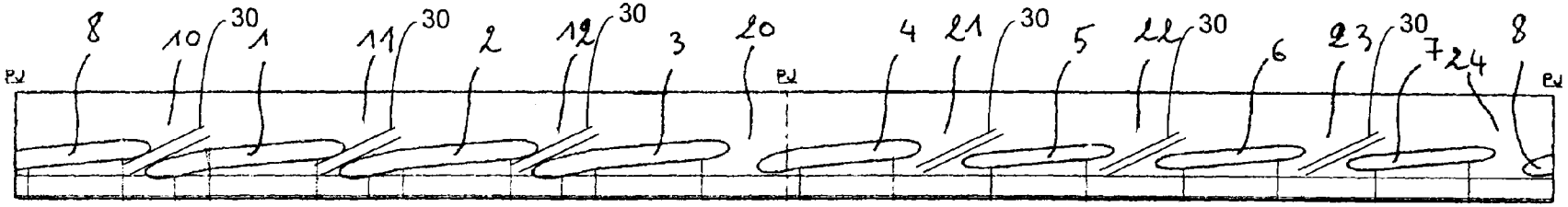

At the start of rotation of a cap shown in FIG. 2, engaging portions 30 of said cap enter into engagement in the intervals 10, 11 and 12.

The cap is deformed when lifted up on the side comprising said intervals 10, 11 and 12.

The vacuum is broken such that the cap returns to its initial shape by lifting up elsewhere than on the side comprising the intervals 10, 11 and 12. The engaging portions 30 of said cap are capable of coming into contact with the lower part of the threads 4 and 8, then the threads 5, 6 and 7, possibly by rotation (unscrewing) of the cap.

The cap thus successively enters into engagement in the intervals 10, 11 and 12, then 20, 24, then 21, 22 and 23. Finally it regains its initial shape.

The opening thereof is absolutely guaranteed.

The invention claimed is:

1. A hollow vacuum packaging product, comprising:

a ring having a plurality of threads distributed around a periphery of the ring, wherein a sealing cap is configured to enter into engagement with the packaging product between one or more of the threads of the ring when the hollow product is opened/closed, wherein in an evacuated closed condition of the hollow product, the sealing cap is configured to enter into engagement only in an interval between two consecutive threads or in plural such consecutive intervals, the interval defining a gap extending between the two consecutive threads or in plural such consecutive intervals, and wherein the sealing cap does not enter into engagement in all of the intervals between each of the plurality of threads, wherein the interval(s) in which the sealing cap is configured to enter into engagement in the evacuated closed condition of the hollow product are located only in one half of a periphery of the ring, on a first side of a joint plane of a mold.

2. The hollow product as claimed in claim 1, wherein the interval(s) in which the sealing cap is configured to enter into engagement in the evacuated closed condition of the hollow product are defined, in a lower part thereof, by a thread with a double pitch.

3. The hollow product as claimed in claim 1, wherein the interval(s) in which the sealing cap is configured to enter into engagement in the evacuated closed condition of the hollow product are defined, in a lower part thereof, by a thread with a maximum evolute.

4. The hollow product as claimed in claim 1, wherein two threads covering a joint plane of a mold have a non-maximum evolute.

5. The hollow product as claimed in claim 1, wherein two threads covering a joint plane of a mold have a double pitch.

6. The hollow product as claimed in claim 1, wherein the threads located in their entirety on a second side of a joint plane of a mold have a non-maximum evolute.

7. The hollow product as claimed in claim 1, wherein the threads located in their entirety on a second side of a joint plane of a mold have a single pitch.

8. The hollow product as claimed in claim 1, wherein the threads located in their entirety on a second side of a joint plane of a mold have a non-maximum width.

9. A thermoplastic jar, vial, or bottle in accordance with claim 1.

* * * * *